US006800140B2

(12) United States Patent
Hansen

(10) Patent No.: US 6,800,140 B2
(45) Date of Patent: Oct. 5, 2004

(54) EXTRACTION CLEANING WITH OPTIMAL CLEANING SPEED

(75) Inventor: Samuel N. Hansen, Jenison, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 153 days.

(21) Appl. No.: 10/044,890

(22) Filed: Jan. 11, 2002

(65) Prior Publication Data

US 2002/0083548 A1 Jul. 4, 2002

Related U.S. Application Data

(63) Continuation-in-part of application No. 09/593,126, filed on Jun. 13, 2000, now Pat. No. 6,446,302.

(51) Int. Cl.[7] ..... A47L 11/29

(52) U.S. Cl. ..... 134/21; 15/320; 15/339; 15/340.1; 15/340.2

(58) Field of Search ..... 15/320, 339, 340.1, 15/340.2; 134/21

(56) References Cited

U.S. PATENT DOCUMENTS

| | | | | | |
|---|---|---|---|---|---|
| 4,766,432 | A | * | 8/1988 | Field | 15/339 |
| 5,237,720 | A | | 8/1993 | Blase et al. | 15/321 |
| 5,323,483 | A | | 6/1994 | Baeg | 15/319 |
| 5,357,649 | A | * | 10/1994 | Hasegawa et al. | 15/320 |
| 5,539,953 | A | | 7/1996 | Kurz | 15/367 |
| 5,608,944 | A | | 3/1997 | Gordon | 15/319 |
| 5,613,261 | A | | 3/1997 | Kawakami et al. | 15/98 |
| 5,636,402 | A | * | 6/1997 | Kubo et al. | 15/320 |
| 5,748,853 | A | * | 5/1998 | Deschenes | 15/339 |
| 5,815,884 | A | | 10/1998 | Imamura et al. | 15/339 |
| 5,839,156 | A | | 11/1998 | Park et al. | 15/339 |
| 5,841,259 | A | | 11/1998 | Kim et al. | 15/340.1 |
| 5,867,861 | A | | 2/1999 | Kasen et al. | 15/320 |
| 5,937,475 | A | | 8/1999 | Kasen et al. | 15/320 |
| 5,987,696 | A | | 11/1999 | Wang | 15/319 |
| 6,055,702 | A | | 5/2000 | Imamura et al. | 15/339 |
| 6,167,587 | B1 | | 1/2001 | Kasper et al. | 15/320 |
| 6,176,940 | B1 | | 1/2001 | Wang | 134/21 |

* cited by examiner

*Primary Examiner*—Theresa T. Snider
(74) *Attorney, Agent, or Firm*—McGarry Bair PC

(57) ABSTRACT

An extraction surface cleaning apparatus is provided having an extraction head adapted to be moved over a floor surface to be cleaned, a handle mounted to the extraction head for grasping by a user and propelling the extraction head over the floor surface, and an application and recovery system fluidly interconnected with the extraction head and movable therewith to apply at least one of water and cleaning solution to the floor surface and extract the same in combination with any dirt entrained therein. A detector is mounted to the extraction head for detecting the relative speed of the extraction head relative to the floor surface and generating a signal representative of such relative speed. An indicator is operably interconnected with the detector and is adapted to receive the signal generated by the detector and provide an indication to a user representative of the signal.

20 Claims, 8 Drawing Sheets

EXTRACTION CLEANING WITH OPTIMAL CLEANING SPEED

CROSS-REFERENCE TO RELATED APPLICATIONS

This application is a continuation-in-part of U.S. patent application Ser. No. 09/593,126, filed Jun. 13, 2000, now U.S. Pat. No. 6,446,302.

BACKGROUND OF THE INVENTION

1. Field of the Invention

This invention relates to an extraction cleaning machine and, more particularly, to an upright extraction cleaning machine. In another of its aspects, the invention relates to an upright extraction cleaning machine with a speed sensor which detects the speed that the base housing of the cleaning machine is moving, whether by propulsion or by manual movement. In an additional aspect, the invention relates to a method for optimally removing dirt from a floor surface by operating the extraction cleaning machine at an optimal speed.

2. Description of the Related Art

Upright extraction cleaning machines have been used for removing dirt from surfaces such as carpeting, upholstery, drapes and the like. The known extraction cleaning machines can be in the form of a canister-type unit as disclosed in U.S. Pat. No. 5,237,720 or an upright unit as disclosed in U.S. Pat. No. 5,867,861.

Either type of unit contains a suction nozzle for withdrawing a typical mixture of applied cleaning solution, water and dirt embedded or contained on a floor surface and a fluid delivery system for depositing a mixture of cleaning solution on the floor surface. It has been found that the speed at which the suction nozzle and/or fluid is applied to the surface can have a significant effect on the cleaning machine's ability to effectively clean a floor surface.

Moving the extraction head too quickly over a floor surface can prevent the extraction head from withdrawing an insufficient amount of dirt, thus leaving the floor surface with an undesirable amount of retained dirt and/or a water/cleaning solution mixture—thus, the carpet would be either dirtier than desired or left with a high accumulation of water/cleaning solution embedded therein and would require an extended period of drying time.

Moving the extraction head too slowly over a floor surface, while extracting virtually the same amount of water from the floor surface being cleaned, can simply result in the user taking an undesirably long period of time to perform the extraction process.

Thus, it can be seen that the degree of cleaning of an extraction cleaning machine depends on a number of factors, including the speed of the machine along the surface to be cleaned, the relative amounts of cleaning solution and water, the amount of soil in the carpet or surface, the amount of suction applied to remove the dirty fluid from the carpet or other surface and the temperature of the cleaning fluid. The speed that the extractor head is passed along a floor surface typically depends on the operator. Thus, the rate of cleaning will likely vary by operator and, hence, the perceived effectiveness of the extraction cleaning machine.

SUMMARY OF THE INVENTION

The invention relates to speed-sensing system adapted to a deep cleaner. The speed sensing system comprises a magnetic pick-up sensor located on at least one of the wheels of the upright deep cleaner, a printed circuit board comprising the necessary computer logic to process signals received from the magnetic sensor, a plurality of light emitting diodes (LED) which illuminate upon a signal from the printed circuit board, a housing to enclose the printed circuit board, and associated wiring harnesses to electrically connect the sensor, the printed circuit board, and the light emitting diodes. In operation, the magnetic sensor senses the rate of rotation of the wheel on the upright deep cleaner. The printed circuit board synthesizes the inputs from the sensor and selectively lights the appropriate number of LEDs. The system is configured such that as the rotational speed of the upright deep cleaner wheel increases, additional LEDs are lit. The advantage of the speed sensing system is that optimum deep cleaning is achieved when the deep cleaner is moved along the surface at a certain predetermined speed. The speed sensor described herein provides a visual indication to the user that the upright deep cleaner is moving across the carpet at a rate that will achieve optimum cleaning performance. In an alternate embodiment, the visual indicating lights may be replaced by an audible indication to the user.

In one aspect, the invention relates to an extraction surface cleaning apparatus having a housing, at least two wheels mounted to the housing for supporting the housing for movement along a surface to be cleaned, and a liquid dispensing system mounted to the housing. The liquid dispensing system can include a liquid dispensing nozzle for applying liquid to a surface to be cleaned, a fluid supply chamber for holding a supply of cleaning fluid, and a fluid supply conduit fluidly connected to the fluid supply chamber and to the dispensing nozzle for supplying liquid to the dispensing nozzle. A fluid recovery system is mounted to the housing and includes a recovery chamber for holding recovered fluid, a suction nozzle, a working air conduit extending between the recovery chamber and the suction nozzle, and a vacuum source in fluid communication with the recovery chamber for generating a flow of working air from the suction nozzle through the working air conduit and through the recovery chamber. Dirty liquid is thereby drawn from the surface to be cleaned through the suction nozzle and the working air conduit, and into the recovery chamber. An improvement to the art of extraction cleaners comprises a detector for sensing the speed of the housing across the surface being cleaned and for generating a speed signal representative thereof, and an output device mounted on the housing and coupled to the detector for displaying or audibly expressing the relative speed of the housing across the floor being cleaned.

In another aspect, the invention relates to an extraction surface cleaning apparatus having an extraction housing including a suction nozzle adapted to be moved along a floor surface to be cleaned, a handle mounted to the extraction housing for grasping by a user and propelling the extraction housing over the floor surface, and a cleaning fluid delivery system interconnected with the extraction housing and movable therewith to apply a cleaning solution to the floor surface. A fluid recovery system is interconnected with the extraction housing to recover soiled cleaning solution from the floor surface. A detector is mounted to the extraction housing for detecting the relative speed of the extraction housing relative to the floor surface and for generating a signal representative of the detected speed. An output device is operably interconnected with the detector, and is adapted to receive the signal generated by the detector and to indicate to a user the detected relative speed of the extraction housing.

In various embodiments of the invention, the detector can be aligned with and adjacent to one of the at least two wheels adapted to detect the rotational motion of the one of the at least two wheels without physically contacting the wheel. The detector can comprise a first disk portion mounted to the one of the at least two wheels for rotation therewith, and a second pick-up portion fixedly mounted to the housing aligned with and adjacent to the first disk portion adapted to generate a signal representative of the rotation of the first disk portion. The first disk portion can have alternating opposite-polarity magnetic segments thereon and the second pick-up portion is adapted to detect the rotational speed of the first disk portion by detecting changes in the magnetic polarity of a particular segment of the first disk portion located adjacent to the second pick-up portion. The output device can comprise a converter interconnected with the detector and adapted to change the speed signal from the detector into a visual indicator of the speed of the housing across the floor. The visual indicator can comprise at least one light-emitting diode that emits light representative of the speed signal received from the detector. The at least one light-emitting diode can comprise a series of light-emitting diodes wherein output device illuminates a particular number of the series of light-emitting diodes proportional to the speed signal received from the detector.

The indicator can be mounted to the handle, the base or preferably any other line of sight of a user between a position behind the handle and the extraction housing. The handle can be pivotally mounted to the extraction head. The fluid delivery and fluid recovery systems can be carried on the extraction housing.

In a further aspect, the invention relates to a method of cleaning a floor surface with an extraction cleaner comprising the steps of: moving the extraction cleaner across the floor surface; depositing a cleaning solution from the extraction cleaner on the floor surface; recovering soiled cleaning solution from the floor surface with the extraction cleaner; detecting the relative speed of the extraction cleaner with respect to the floor surface; and communicating to a user the detected relative speed of the extraction cleaner.

The communicating step can further comprise generating a visual signal. The communicating step can comprise generating an audible signal. The communicating step can further comprise generating a speed signal representative of said detected speed and converting the speed signal to an audible or visual signal that is readable and understandable by a user operating the extraction cleaner. The method can also further comprise the step of generating a predetermined reference signal and comparing the reference signal to the speed signal. The method can also further comprise the step of alerting a user if the difference between the reference signal and the speed signal exceeds a predetermined threshold.

BRIEF DESCRIPTION OF THE DRAWINGS

The invention will now be described with reference to the drawings wherein.

DESCRIPTION OF THE PREFERRED EMBODIMENTS

The extraction cleaning machine according to the invention can be of any known type of extraction cleaning machine including, but not limited to those disclosed in U.S. Pat. Nos. 6,167,587 and 5,937,475, both of which are incorporated herein by reference. A preferred embodiment of the extraction cleaning machine is shown in U.S. patent application Ser. No. 09/593,126, filed Jun. 13, 2000, now U.S. Pat. No. 6,446,302, which is also specifically incorporated herein by reference.

It will be also understood that, although an upright extraction cleaning machine is shown throughout, the invention is equally applicable to other types of extraction cleaning machines, including canister-type machines, and the type of cleaning machine shown herein shall not be construed as limiting on the invention.

Figure 1:
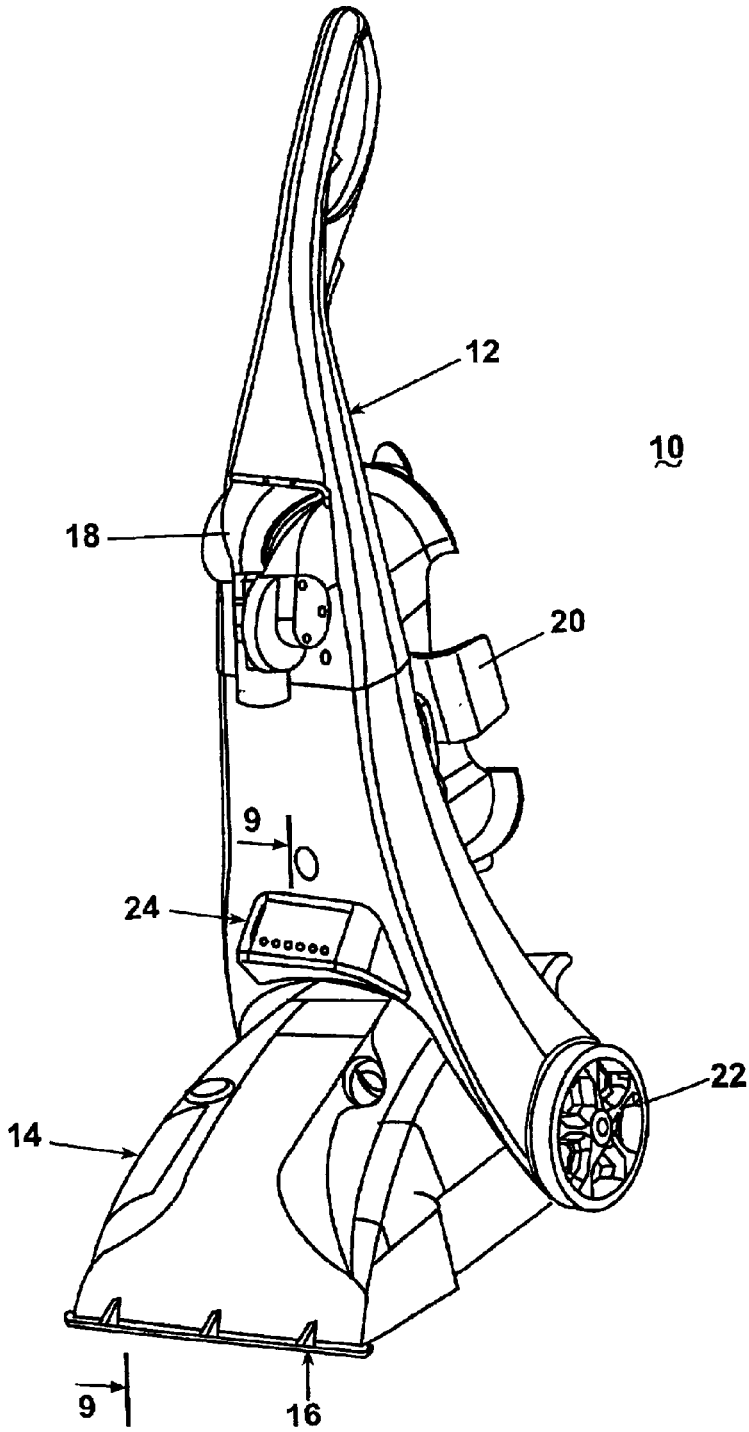
FIG. 1 is a perspective view of a deep cleaning extraction cleaner, of the upright type, incorporating a speed sensor operably interconnected with wheels attached to a base portion of the extraction cleaner according to the invention.

Turning now to the drawings and to FIG. 1 in particular, an example of an extraction cleaner 10 is shown, of the upright-type by example, comprising an elongated handle 12 pivotally interconnected to a base 14 having an extraction head 16. The handle 12 can carry various accessory components and convenience features such as a hose nozzle 18 and a hose mount rack 20 shown by example in FIG. 1. The basic operation of the extraction head 16 to remove dirt from a floor surface using a suction source and a recovery tank is well known and need not be described herein to be understood by one skilled in the art. The extraction cleaner 10 also includes a pair of wheels 22 (of which only one wheel 22 is shown in the orientation of FIG. 1 but that the other wheel is oppositely positioned with respect to the shown wheel 22) rotatably mounted to the extraction cleaner 10 in a floor-engaging position. The particular mounting of the wheels 22 to the handle 12 and/or the base 14 shall not be construed as limiting on this invention, but rather, the wheels 22 need only be mounted to the extraction cleaner 10 so that the extraction head 16 can be conveniently passed over the floor surface desired to be cleaned.

In accordance with the invention, a speed indicator 24 is mounted to the extraction cleaner 10, such as on a front surface of the handle 12, preferably in alignment with and ergonomic visual sight path of a user of the extraction cleaner 10. For example, in the configuration shown in FIG. 1, the speed indicator 24 is mounted on the front surface of the handle 12 which, when the handle 12 is pivoted downwardly to a generally angular use position by the user, the speed indicator 24 is easily viewed by a user, who typically will be observing the point at which the extraction head 16 is interfacing with the floor surface being cleaned.

Figure 2:
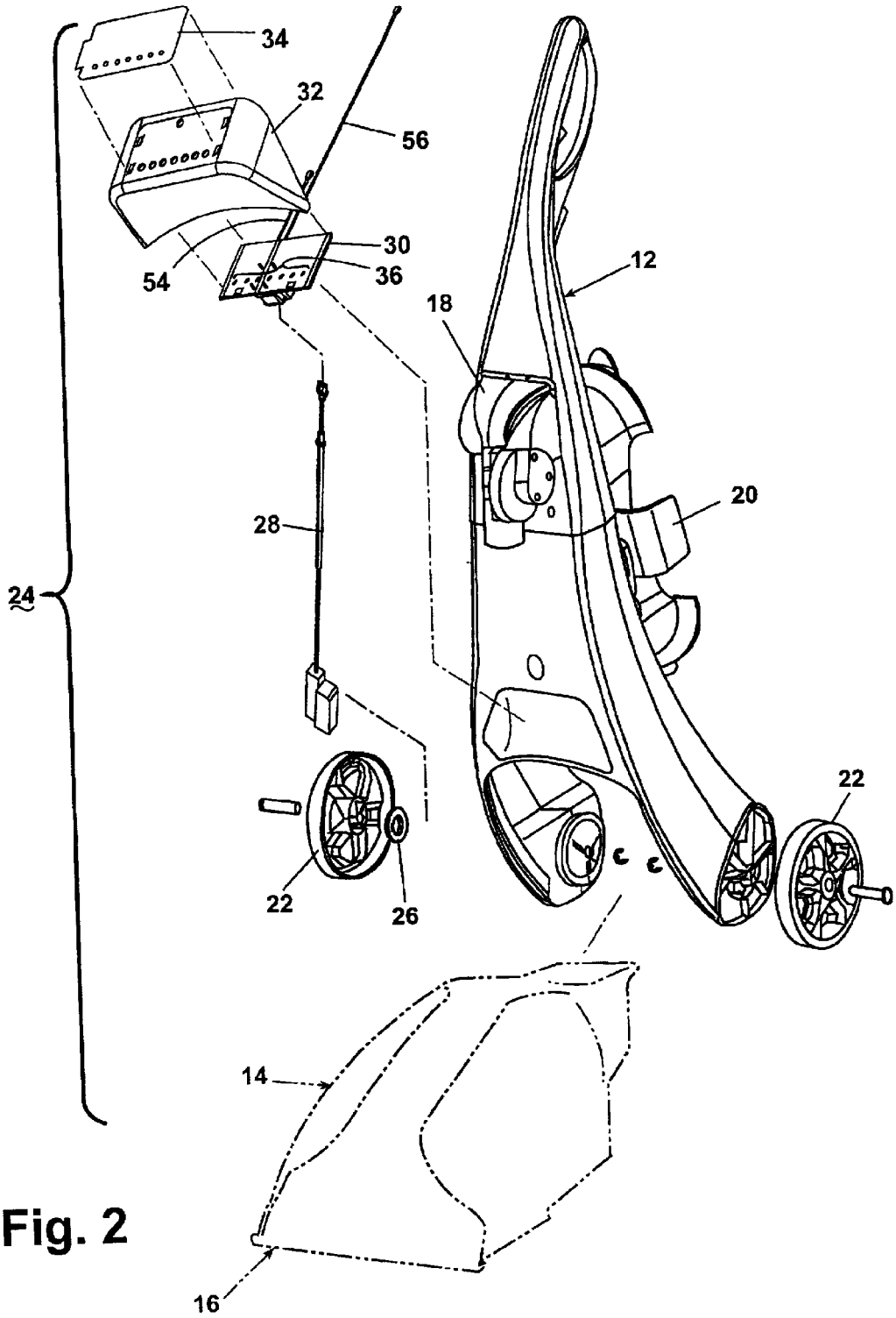
FIG. 2 is an exploded, perspective view of a portion of the deep cleaning machine shown in FIG. 1 showing in detail the components making up the speed sensor operably interconnected with the wheels, including a keyed magnetic disk attached to one of the wheels, a magnetic pick-up device aligned with the keyed magnetic disk and interconnected with circuit components which provide an audio and/or visual indication to user of the speed at which an extraction head of the extraction cleaner is being propelled.

The components making up the speed indicator 24 are shown in greater detail in FIG. 2 and include a keyed magnetic disk 26, a magnetic pick-up device 28, circuit componentry 30 containing necessary computer logic to process signals received from the magnetic pick-up device 28, a speed indicator housing 32, and a faceplate 34 therefor. The circuit componentry 30 preferably includes a plurality of light-emitting diodes (LEDs) which illuminate when a voltage signal is applied from the printed circuit board. While the components of the speed indicator 24 are shown herein as configured to provide the visual indication of the speed of the extraction cleaner 10, it is also within the scope of the invention to configure the components of the circuit componentry 30 to provide an audible indication of such speed.

Figure 3:
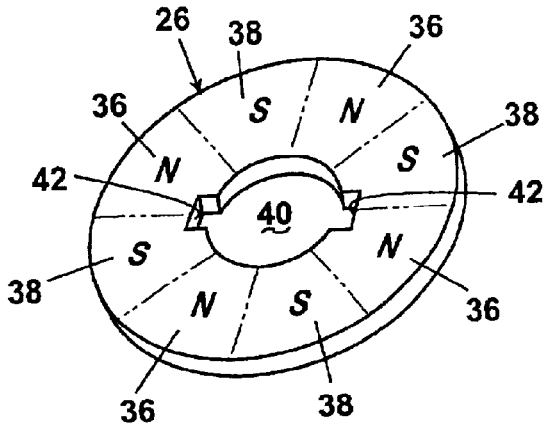
FIG. 3 is a perspective view showing the keyed magnetic disk of FIG. 2 in greater detail.

The keyed magnetic disk 26 is shown in greater detail in FIG. 3 and comprises a generally disk-shaped body charged magnetically therearound and alternating pie-shaped segments of opposite polarity, such as the north and south segments 36 and 38 shown in FIG. 3. It has been found that a magnetic field strength of each segment 36 and 38 is preferably greater than 25 gauss at the surface of the magnetic disk 26. For optimum performance, testing indicates that a field strength of 50 gauss at 0.200 inches from each surface of the magnetic disk 26 is preferred.

Figure 4:
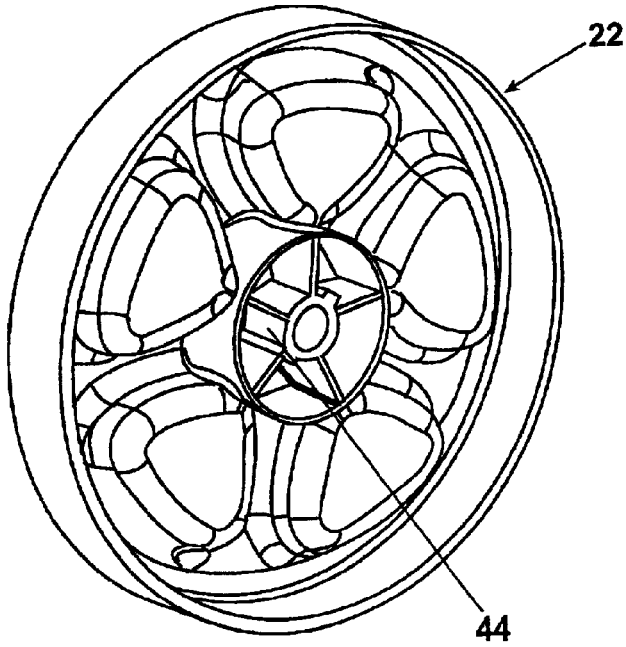
FIG. 4 is a perspective view showing one of the wheels of FIGS. 1–2 with particular attention paid to an interior surface of the wheel.

The disk 26 also includes a central opening 40, preferably generally circular in configuration, having at least one, and preferably two, discontinuous keyed portions 42. The central opening 40 and its associated keyed portions 42 are adapted to be inserted and retained on a correspondingly-configured axle 44 preferably extending inwardly from an interior surface of a wheel 22 as shown in FIG. 4. The axle 44 of the wheel 22, as can be seen in FIG. 4, preferably has an outer periphery dimensioned to receive the central opening 40 of the keyed magnetic disk 26 so that, when the wheel 22 rotates when rolled over a floor surface to be cleaned, the keyed magnetic disk 26 rotates therewith.

Figure 5:
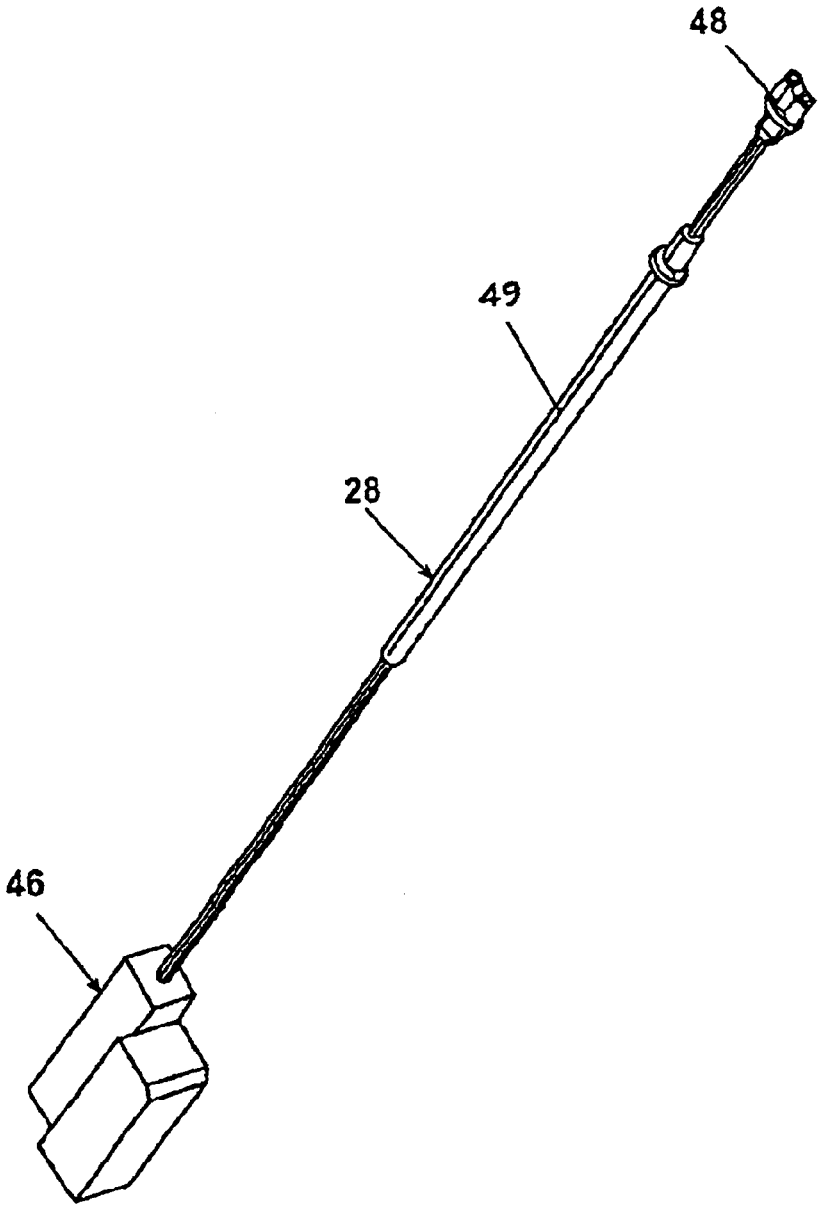
FIG. 5 is a perspective view showing the magnetic pick-up device of FIG. 2 in greater detail.

Referring to FIG. 5, the magnetic pick-up device 28 is shown in greater detail comprising a reed switch 46 at one end thereof interconnected to a terminated connector 48 by a suitable conduit, such as wiring 49. The reed switch 46 is configured to close when immersed in a uniform magnetic field. Preferably, a minimum field strength to close the reed switch 46 is approximately 10 gauss. For optimum performance, testing indicates that a preferable field strength of 15.8 gauss is required. For application with the extraction cleaner 10 described herein, any of the many known switching and pick-up devices can be employed without departing from the scope of this invention. By way of example only, one appropriate reed switch 46 among the many available can be ALF Part. No. HYR-1532 or Gentech Part No. GR21 and can be preferably specified to operate at 250V DC with a maximum switching voltage of 200V DC, a contact rating of 10W, and a maximum switching current of 0.5A.

Figure 6:
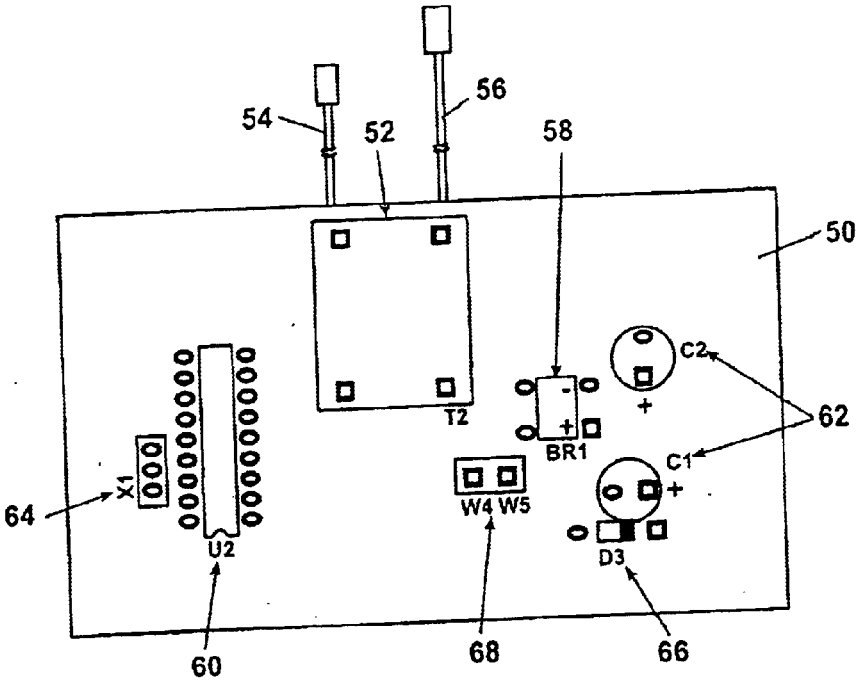
FIG. 6 is a top plan view showing an example of circuit componentry suitable for receiving a speed signal from the magnetic pick-up device of FIG. 5 and converting that signal into a signal receivable and understandable by a user.
Figure 7:
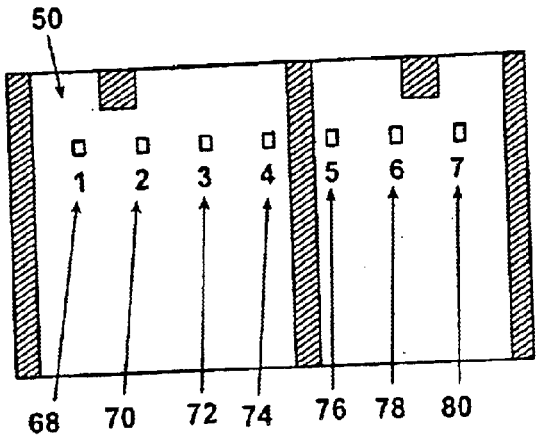
FIG. 7 is a top plan view showing an example of a faceplate for a visual speed indicator which indicates by a series of progressively illuminating light emitting diodes (LEDs) which is adapted to align with the circuit componentry of FIG. 6 whereby, as the speed at which the extraction cleaner is propelled across a floor surface increases, a larger number of the LEDs is illuminated representative of the propelled speed of the extraction cleaner.
Figure 8:
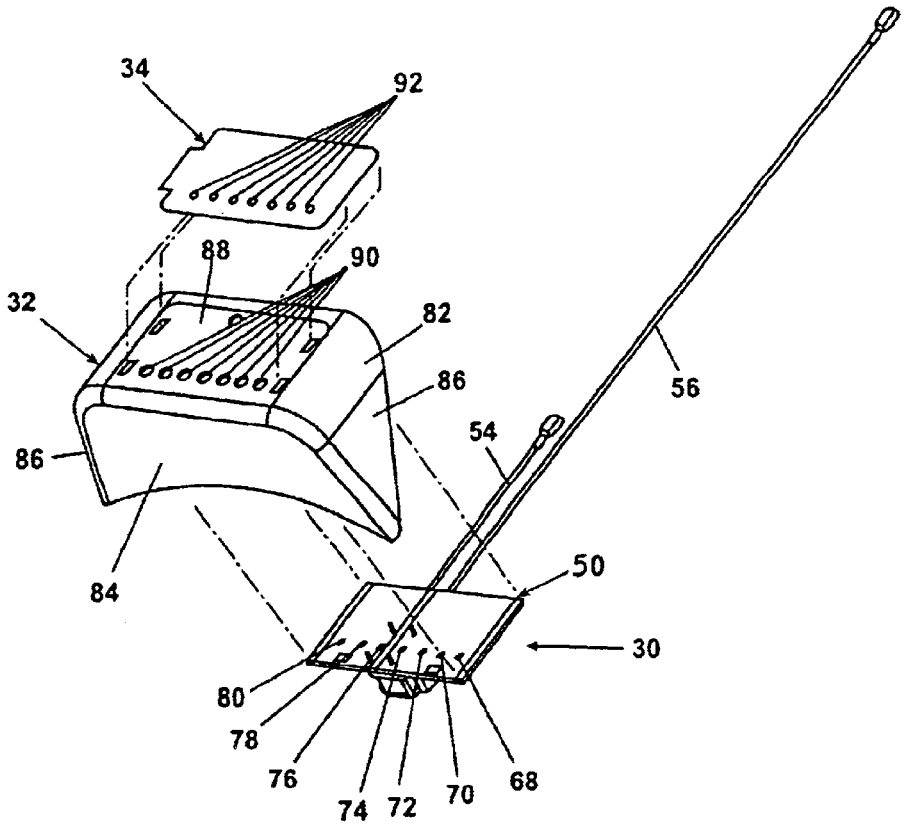
FIG. 8 is an exploded perspective view showing the magnetic pick-up device of FIG. 5 interconnected with the circuit componentry of FIG. 6 and aligned with the faceplate of FIG. 7 in showing the alignment and positioning of these components with respect to a housing for these components which is adapted to be mounted to the extraction cleaner as shown and FIG. 1, or in any suitable location preferably visually aligned with the sight path of a user of the extraction cleaner.

Referring to FIGS. 6–8, the circuit componentry 30 can comprise a bare non-conductive circuit board 50 with associated conductive signal tracks. While the particular components employed to generate an indication of the speed at which the extraction cleaner 10 is propelled are not critical to the invention as many configurations of particular componentry 30 can be employed within the scope of this invention. In the example shown in the drawings, a first side of the circuit board 50 includes a transformer 52 with first and second input electrical leads 54 and 56 for ground and power input, respectively, a bridge 58, a computer chip 60, one or more capacitors 62, a resonator 64, a zener diode 66, and a two pin connector 68. A second side of the circuit board 50 comprises a plurality of light emitting diodes (LEDs) 68–80 formed a serial alignment and connected to the computer chip 60. These commonly-known electrical components are configured to process inputs from the reed switch 46 and illuminate a predetermined number of the LEDs 68–80 simultaneously, depending on the frequency of the input signals received from the magnetic pick-up device as will be described.

In the preferred embodiment, the LEDs 68–80 will preferably illuminate at the following speed ranges:

| LED | REFERENCE NUMERAL | SPEED RANGE (in/sec) |
|---|---|---|
| #1 | 68 | 0.1 to 4 |
| #2 | 70 | 4 to 8 |
| #3 | 72 | 8 to 12 |
| #4 | 74 | 12 to 16 |
| #5 | 76 | 16 to 20 |
| #6 | 78 | 20 to 24 |
| #7 | 80 | 24 and higher |

The housing 32 and the faceplate 34 for the speed indicator 24 are shown and greater detail in FIG. 8. The housing 32 is essentially designed to be mounted to the extraction cleaner 10, preferably on the handle 12, for providing an aesthetically-pleasing interface for the speed indicator 24 to a user of the extraction cleaner 10. In general, the housing 32 comprises a generally inverted U-shaped shell 82 having a rear wall 84 and leading walls 86 adapted to be attractively mounted onto the front surface of the handle 12. An upward-facing surface 88 of the shell 82 includes a series of apertures 90 arranged in spacing and alignment with the spacing and alignment of the LEDs 68–80 on the circuit board 50. The faceplate 34 also has a series of apertures 92 similarly arranged in spacing and alignment with the spacing and alignment of the LEDs 68–80 on the circuit board 50.

Figure 9:
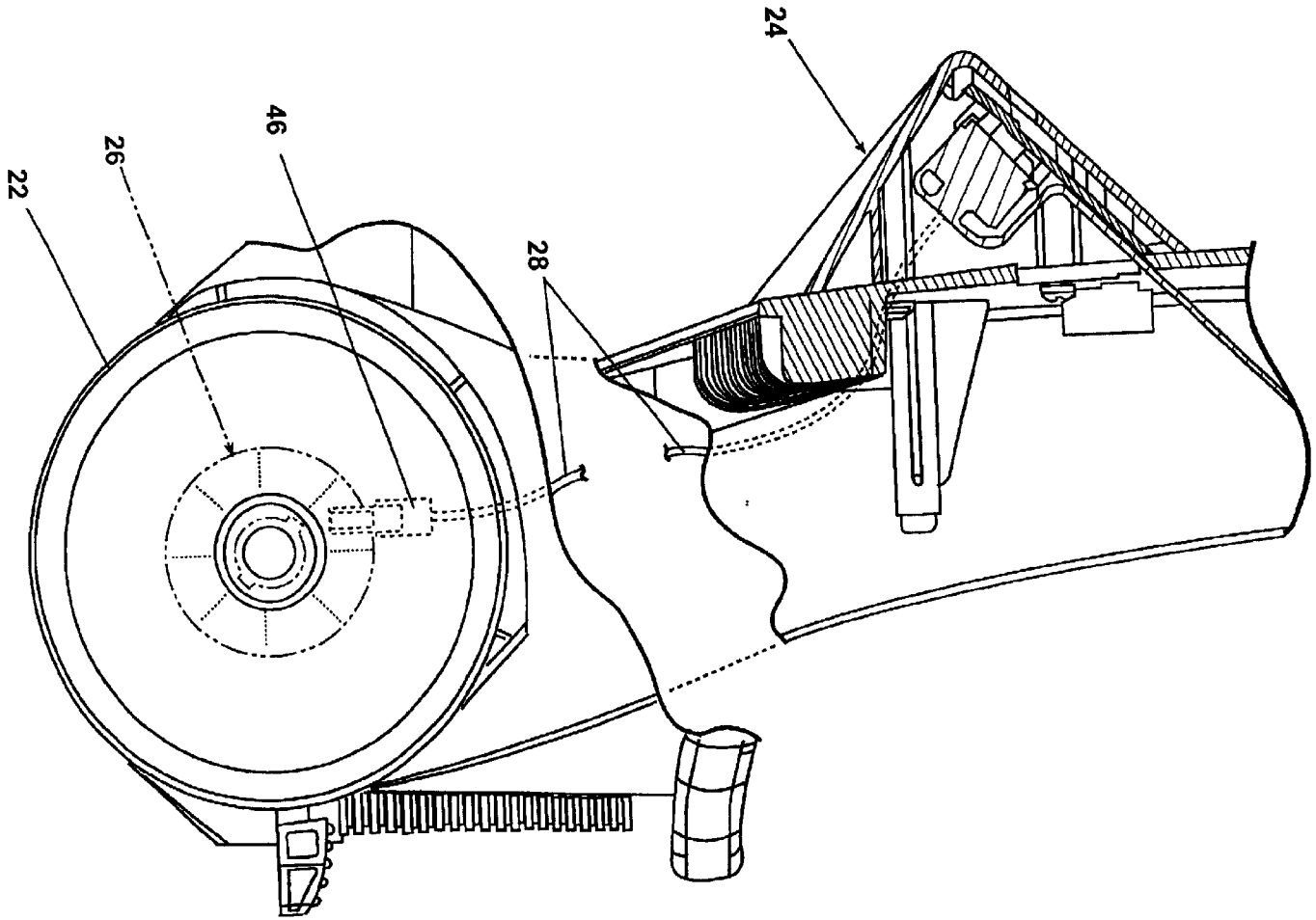
FIG. 9 is a fragmentary, cross-sectional view taken along lines 9—9 of FIG. 1 showing the mounting of the keyed magnetic disk to one of the wheels of the extraction cleaner and the positioning of the magnetic pick-up device with the keyed magnetic disk and the subsequent interconnection of the magnetic pick-up device with the circuit componentry of that rotation of the wheel of the extraction cleaner is converted into a signal receivable and understandable by a user by viewing the LEDs on the speed indication housing.

In assembly, as shown in FIGS. 1–2 and 8–9, the central opening 40 of the keyed magnetic disk 26 is inserted onto the shaft 44 of one of the wheels 22 of the extraction cleaner 10 so that the keyed magnetic disk 26 rotates directly with the wheel 22 as a result of the engagement of the discontinuous protrusion 42 of the central opening 40 of the keyed magnetic disk 26 with the similar protrusion on the central shaft 44 of the wheel 22. The reed switch 46 is preferably mounted within the extraction cleaner 10 to be adjacent to and aligned with the keyed magnetic disk 26 as shown in FIG. 9. Preferably, the reed switch 46 is fixed an a location no further away than 0.200 inches from the magnetic disk 26. The wiring 49 of the magnetic pick-up device 28 is extended through the extraction cleaner 10 and interconnected to the suitable connector 68 on the circuit board 50 of the circuit componentry 30.

The circuit componentry 30 is preferably mounted within the shell 82 of the housing 32 by conventional fasteners, such as resilient detent clips mounted within corresponding openings in either the circuit componentry 30 or the housing 32. As further shown in FIG. 9, the faceplate 34 is mounted to the surface 88 of the shell 32 in a manner that the apertures 92 of the faceplate 34, the apertures 90 of the shell 32 and the LEDs 68–80 of the circuit board 50 are each normally aligned with one another so that illumination emitted from the LEDs upon a suitable signal from the circuit componentry 30 is visible through the aligned apertures 90 and 92. The ground and power lead 54 and 56 extending from the circuit board 50 are preferably interconnected with an incoming line power supply (not shown) typically provided with the types of extraction cleaners 10.

A front face of the faceplate 34 can be provided with indicia which provides the user with information regarding the speed at which the extraction head 16 is traveling across the floor surface being cleaned.

While the invention has been described with reference to the housing 32 located on the front surface of the handle 12 such that the indicia on the faceplate 34 is in direct view of the user during use, other locations that preferably provide a direct line of sight between the user and the faceplate indicia are available elsewhere on either the handle or the base are within the scope of this invention. For example, the housing 32 for the indicator 24 could be located on the base 14, such as on an upper surface of the extraction head 16.

In operation, the wheels 22 rotate as the user moves the extraction cleaner 10 forward and backwards across the floor surface being cleaned. The magnetic disk 26 in one of the wheels 22 rotates along with the wheel 22, passing the alternating, opposite-polarity segments 36 and 38 of disk 28 directly adjacent to the reed switch 46. In accordance with the typical operation of a reed switch as is well known in the art, the reed switch 46 opens and closes according to the strength of the field encountered. The field strength of each segment 36, 38 of the magnetic disk 26 is strongest in the center of each segment and is weakest at a border transition between the opposing polarities. The frequency at which the reed switch 46 opens and closes is processed by the componentry 30 on printed circuit board 50.

The LEDs 68–80 are illuminated in ascending fashion by the computer chip 60, based on programmed criteria and in response to the input signal from the reed switch 46. The programmed criteria, in the preferred embodiment, provides guidance to the user that corresponds to an optimal speed of movement of the deep cleaner for effective cleaning as is described further with respect to FIGS. 10–12. As can be appreciated, the visual LEDs 68–80 can be replaced with an audible output to indicate speed to the user.

The programmed criteria, as mentioned above, can be as simple as a predetermined input speed signal which is compared to the speed signal received from the magnetic pick-up device 28 or a more complicated algorithm which factors in the quality of the water extracted from the floor surface being cleaned, the speed signal received from the magnetic pick-up device, and other environmental factors such as temperature of the water being applied, the type of floor surface being cleaned, and the like.

Figure 10:
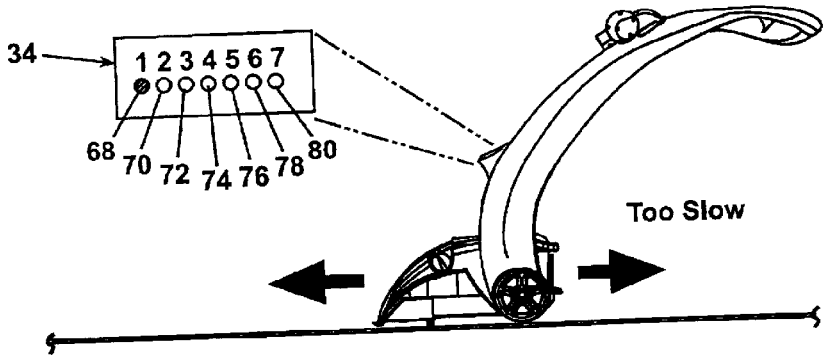
FIGS. 10–12 are side elevational views showing the use of the extraction cleaner of FIG. 1 whereby the extraction cleaner is being propelled at an undesirably slow speed (FIG. 10), an optimal cleaning speed (FIG. 11), and an undesirably fast speed (FIG. 12) and the faceplate and associated LEDs are also shown in each of these figures in an enlarged inset detailing the increase in the number of illuminated LEDs as the speed increases from FIG. 10 to FIG. 11 to FIG. 12.
Figure 11:
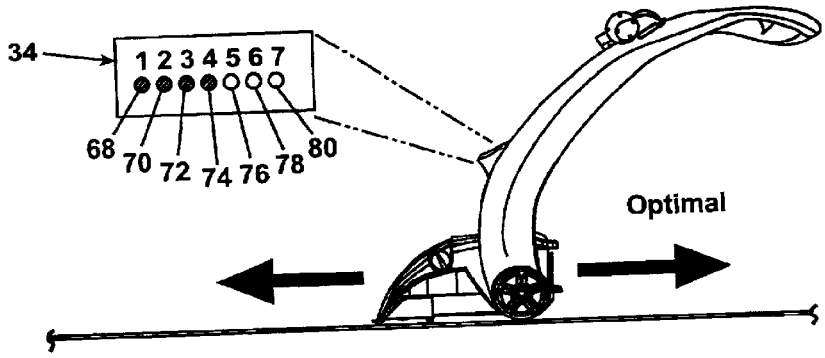
Figure 12:
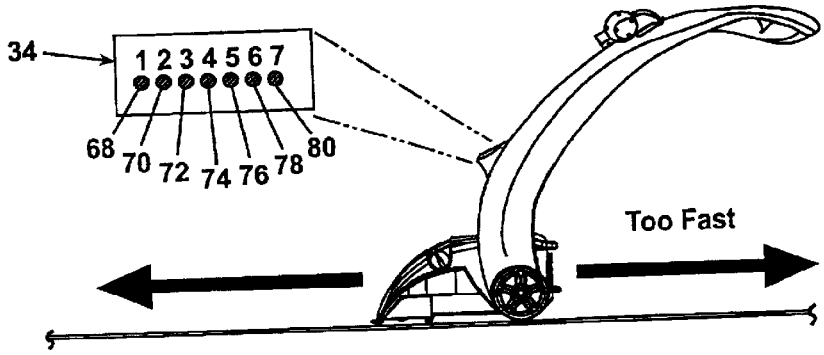

FIGS. 10–12 illustrate the output of the speed indicator 24 during use of the extraction cleaner 10. Preferably, the extraction cleaner 10 will be moved at a linear speed that is optimally selected for the most efficient withdrawal of dirt and applied water/cleaning solution from the floor surface being cleaned. The situation is shown in FIG. 11 with medium-sized arrows showing the optimal linear speed and the corresponding output shown on the faceplate 34 of the speed indicator 24 whereby approximately half of the LEDs are illuminated. Preferably, the LEDs can be colored so that a user can easily discern whether the extraction cleaner 10 is being moved at an optimal speed. Less desirable speed for the extraction cleaner 10 are shown in FIGS. 10 and 12 whereby the arrows are shorter and longer, respectively, indicating undesirable slower and faster linear speed for the extraction cleaner 10. Further, FIGS. 10 and 12 show less and more of the LEDs being illuminated on the faceplate 34 of the speed indicator 24 thereby indicating to the user that the extraction cleaner 10 should be sped up or slowed down accordingly. Alternatively, the LEDs 68–80 can be illuminated in succession, where only a single LED (68–80) provides indication to a user of the speed of the extraction cleaner 10.

It will be understood that a direct-drive motor can be operably interconnected with the base with a speed controller interconnected thereto, for operating the extraction cleaner 10 at an optimal linear speed.

In any of the embodiments described herein, the speed indicator 24 for the extraction cleaner 10 provides substantial benefits over prior art extraction cleaners by indicating to a user the appropriate speed by which to propel the extraction cleaner 10 to optimally clean the floor surface.

While the invention has been specifically described in connection with certain specific embodiments thereof, it is to be understood that this is by way of illustration and not of limitation, and the scope of the appended claims should be construed as broadly as the prior art will permit.

What is claimed is:

1. An extraction surface cleaning apparatus having:

a housing;

at least two wheels mounted to the housing for supporting the housing for movement along a surface to be cleaned;

a liquid dispensing system mounted to the housing and including:

a liquid dispensing nozzle for applying a cleaning fluid to the surface to be cleaned;

a fluid supply chamber for holding a supply of cleaning fluid;

a fluid supply conduit fluidly connected to the fluid supply chamber and to the dispensing nozzle for supplying cleaning fluid to the dispensing nozzle;

a fluid recovery system mounted to the housing and including:

a recovery chamber for holding recovered fluid, a suction nozzle, a working air conduit extending between the recovery chamber and the suction nozzle; and a vacuum source in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber;

a detector mounted on the housing for sensing the speed of the housing across the surface being cleaned and for generating a speed signal representative thereof;

an output device mounted on the housing and coupled to the detector for displaying or audibly expressing the relative speed of the housing across the surface being cleaned;

wherein the detector is aligned with and adjacent to one of the at least two wheels and is adapted to detect the rotational motion of the one of the at least two wheels without physically contacting the wheel; and a first disk portion mounted to the one of the at least two wheels for rotation therewith; and wherein the detector is aligned with and adjacent to the first disk portion adapted to generate a speed signal representative of the rotation of the first disk portion;

the improvement comprising:

wherein the first disk portion has alternating opposite-polarity magnetic segments thereon and the detector is adapted to sense the rotational speed of the first disk portion by detecting changes in the magnetic polarity of a particular segment of the first disk portion.

2. The extraction surface cleaning apparatus of claim 1 wherein the output device comprises a converter interconnected with the detector and adapted to change the speed signal from the detector into a visual indicator of the speed of the housing across the surface.

3. The extraction surface cleaning apparatus of claim 2 wherein the visual indicator comprises at least one light-emitting diode that emits light representative of the speed signal received from the detector.

4. The extraction surface cleaning apparatus of claim 3 wherein the at least one light-emitting diode comprises a series of light-emitting diodes wherein output device illuminates a particular number of the series of light-emitting diodes proportional to the speed signal received from the detector.

5. An extraction surface cleaning apparatus having:

an extraction housing including a suction nozzle adapted to be moved along a floor surface to be cleaned;

at least one wheel mounted to the extraction housing in supporting relationship thereto for rotation about a horizontal axis and movement of the extraction housing along the floor surface;

a handle mounted to the extraction housing for grasping by a user and propelling the extraction housing over the floor surface;

a cleaning fluid delivery system interconnected with the extraction housing and movable therewith to apply a cleaning solution to the floor surface;

a fluid recovery system inter-connected with the extraction housing to recover soiled cleaning solution from the floor surface;

a detector mounted to the extraction housing for detecting the relative speed of the extraction housing relative to the floor surface and for generating a signal representative of the detected speed;

wherein the detector is aligned with and adjacent to the at least one wheel and is adapted to detect the rotational motion of the at least one wheel without physically contacting the wheel; and an output device operably interconnected with the detector, adapted to receive the signal generated by the detector and to indicate to the user the detected relative speed of the extraction housing.

6. The extraction surface cleaning apparatus of claim 5 wherein the output device is mounted to the handle.

7. The extraction surface cleaning apparatus of claim 6 wherein the indicator is mounted in a line of sight of the user between a position behind the handle and the extraction housing.

8. The extraction surface cleaning apparatus of claim 5 wherein the handle is mounted to the extraction housing for pivotal movement about the horizontal axis of rotation of the wheels.

9. The extraction surface cleaning apparatus of claim 5 wherein the fluid delivery and fluid recovery systems are carried on the extraction housing.

10. The extraction surface cleaning apparatus of claim 5 wherein the least one wheels comprises at least two wheels mounted to the extraction housing in supporting relationship thereto for rotation about the horizontal axis, and wherein the detector is aligned with and adjacent to one of the at least two wheels.

11. The extraction surface cleaning apparatus of claim 10 and further comprising a first disk portion mounted to the one of the at least two wheels for rotation therewith; and the detector is aligned with and adjacent to the first disk portion and is adapted to generate a speed signal representative of the rotational speed of the first disk portion.

12. The extraction surface cleaning apparatus of claim 11 wherein the first disk portion has alternating opposite-polarity magnetic segments thereon and the detector is adapted to detect the rotational speed of the first disk portion by detecting changes in the magnetic polarity of a particular segment of the first disk portion located adjacent to the detector.

13. The extraction surface cleaning apparatus of claim 12 wherein the output device comprises a converter interconnected with the detector and adapted to change the speed signal from the detector into a visual indicator of the speed of the housing across the floor.

14. The extraction surface cleaning apparatus of claim 13 wherein the visual indicator comprises at least one light-emitting diode that emits light representative of the speed signal received from the detector.

15. The extraction surface cleaning apparatus of claim 14 wherein the at least one light-emitting diode comprises a series of light-omitting diodes wherein the output device illuminates a particular number of the series of light-emitting diodes proportional to the speed signal received from the detector.

16. A method of cleaning a floor surface with an extraction cleaner comprising the steps of:

moving the extraction cleaner across the floor surface;

depositing a cleaning solution from the extraction cleaner on the floor surface;

recovering soiled cleaning solution from the floor surface with the extraction cleaner;

detecting the relative speed of the extraction cleaner with respect to the floor surface and generating a speed signal;

generating a predetermined reference signal of a desired speed of the extraction cleaner;

comparing the reference signal to the speed signal; and communicating to a user an indication of whether the detected relative speed of the extraction cleaner is above or below the desired speed of the extraction cleaner.

17. The method of cleaning a floor surface with an extraction cleaner according to claim 16 wherein the communicating step comprises generating a visual signal.

18. The method of cleaning a floor surface with an extraction cleaner according to claim 16 wherein the communicating step comprises generating an audible signal.

19. The method of claim 16 and further comprising the step of alerting the user if the difference between the reference signal and the speed signal exceeds a predetermined threshold.

20. An extraction surface cleaning apparatus having:

a housing;

at least two wheels mounted to the housing for supporting the housing for movement along a surface to be cleaned;

a liquid dispensing system mounted to the housing and including:

a liquid dispensing nozzle for applying a cleaning fluid to the surface to be a fluid supply chamber for holding a supply of cleaning fluid;

a fluid supply conduit fluidly connected to the fluid supply chamber and to the dispensing nozzle for supplying liquid to the dispensing nozzle;

a fluid recovery system mounted to the housing and including:

a recovery chamber for holding recovered fluid, a suction nozzle, a working air conduit extending between the recovery chamber and the suction nozzle; and a vacuum source in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber;

a detector mounted on the housing for sensing the speed of the housing across the surface being cleaned and for generating a speed signal representative thereof; and an output device mounted on the housing and counted to the detector for receiving the speed signal, the output device further having a display that indicates a predetermined optimum cleaning speed for the extraction surface cleaning apparatus across the surface and wherein the output device is adapted to display an indication of whether the relative speed of the housing across the surface being cleaned is above or below the predetermined optimum cleaning speed.

* * * * *

UNITED STATES PATENT AND TRADEMARK OFFICE

CERTIFICATE OF CORRECTION

PATENT NO. : 6,800,140 B2
DATED : October 5, 2004
INVENTOR(S) : Samuel N. Hansen It is certified that error appears in the above-identified patent and that said Letters Patent is hereby corrected as shown below:

Column 7,
Line 19, reads "the reed switch 46 is fixed an a location" should read -- the reed switch 46 is fixed on a location --.

Column 11,
Line 32, reads "to the surface to be" should read -- to the surface to be cleaned; --.

Signed and Sealed this

Sixteenth Day of August, 2005

JON W. DUDAS
*Director of the United States Patent and Trademark Office*